US011371316B2

(12) United States Patent
Martin et al.

(10) Patent No.: US 11,371,316 B2
(45) Date of Patent: Jun. 28, 2022

(54) MOBILE CEMENT MIXING AND DELIVERY SYSTEM FOR DOWNHOLE WELLS

(71) Applicant: T-ROCK CT SERVICES LTD., Vermilion (CA)

(72) Inventors: Myles Martin, Vermilion (CA); Randy Martin, Vermilion (CA)

(73) Assignee: T-ROCK CT SERVICES LTD., Vermilion (CA)

( * ) Notice: Subject to any disclaimer, the term of this patent is extended or adjusted under 35 U.S.C. 154(b) by 164 days.

(21) Appl. No.: 16/927,617

(22) Filed: Jul. 13, 2020

(65) Prior Publication Data

US 2021/0310331 A1 Oct. 7, 2021

(30) Foreign Application Priority Data

Apr. 6, 2020 (CA) ..... 3077905

(51) Int. Cl.

| | |
|---|---|
| ***E21B 33/13*** | (2006.01) |
| ***E21B 33/16*** | (2006.01) |
| ***B01F 23/53*** | (2022.01) |
| ***B01F 25/20*** | (2022.01) |
| ***B01F 27/112*** | (2022.01) |
| ***B01F 33/82*** | (2022.01) |
| ***B01F 33/502*** | (2022.01) |
| *B01F 101/28* | (2022.01) |

(52) U.S. Cl.

CPC ..... *E21B 33/165* (2020.05); *B01F 23/53* (2022.01); *B01F 25/20* (2022.01); *B01F 27/112* (2022.01); *B01F 33/502* (2022.01); *B01F 33/82* (2022.01); *B01F 2101/28* (2022.01)

(58) Field of Classification Search

CPC .... E21B 33/13; B01F 33/502; B01F 33/5021; B01F 33/5023

See application file for complete search history.

(56) References Cited

U.S. PATENT DOCUMENTS

| | | | | |
|---|---|---|---|---|
| 4,792,234 | A | 12/1988 | Doherty | |
| 4,911,330 | A | 3/1990 | Maanderen et al. | |
| 5,419,632 | A * | 5/1995 | Stephens | E04G 21/0472 366/51 |
| 5,538,286 | A | 7/1996 | Hoff | |
| 5,571,281 | A | 11/1996 | Allen | |
| 5,895,116 | A | 4/1999 | Kreinheder et al. | |
| 6,481,883 | B1 * | 11/2002 | Ellen | B28C 5/166 366/65 |

(Continued)

FOREIGN PATENT DOCUMENTS

| | | | | |
|---|---|---|---|---|
| CA | 2739121 | A1 | 11/2012 | |
| WO | WO-2019200510 | A1 * | 10/2019 | E21B 33/13 |

*Primary Examiner* — Kipp C Wallace
(74) *Attorney, Agent, or Firm* — McCoy Russell LLP

(57) ABSTRACT

An all-in-one mobile wellsite service unit for providing equipment and services at an oil and gas well related to well abandonment is provided. The mobile unit comprises a water storage tank, at least one cement mixing barrel for mixing a cement slurry, a progressive cavity pump for pumping the cement slurry, and a hydraulic hose for connecting to a hydraulic power source to provide power to the cement mixing barrel and the progressive cavity pump. The mobile unit may also contain downhole tools needed for well abandonment, including a well cleaning tool, a cementing tool, a hydraulic packer, and more.

15 Claims, 5 Drawing Sheets

(56) References Cited

U.S. PATENT DOCUMENTS

| | | | | |
|---|---|---|---|---|
| 6,488,088 | B1 * | 12/2002 | Kohli | B28C 5/4231 366/342 |
| 6,644,844 | B2 | 11/2003 | Neal et al. | |
| 8,276,658 | B2 | 10/2012 | Cox et al. | |
| 10,087,709 | B2 | 10/2018 | Padilla et al. | |
| 10,184,300 | B2 | 1/2019 | Stegemoeller | |
| 2003/0202418 | A1 * | 10/2003 | Scartezina | B28C 5/422 366/54 |
| 2008/0197605 | A1 * | 8/2008 | Blaschke | E21B 15/00 280/402 |
| 2009/0211811 | A1 * | 8/2009 | Roussy | E21B 10/64 175/57 |
| 2017/0130554 | A1 * | 5/2017 | Jones | E21B 23/06 |
| 2018/0073346 | A1 * | 3/2018 | Urdaneta | E21B 47/005 |
| 2018/0258736 | A1 | 9/2018 | Urdeneta | |
| 2019/0048247 | A1 | 2/2019 | Pemites et al. | |
| 2019/0203572 | A1 | 7/2019 | Morris et al. | |
| 2019/0217258 | A1 * | 7/2019 | Bishop | B01F 35/2112 |
| 2021/0172282 | A1 * | 6/2021 | Wang | E21B 47/005 |

* cited by examiner

MOBILE CEMENT MIXING AND DELIVERY SYSTEM FOR DOWNHOLE WELLS

CROSS REFERENCE TO RELATED APPLICATION

The present application claims priority to Canadian Patent Application No. 3,077,905 filed on Apr. 6, 2020. The entire contents of the above-listed application is hereby incorporated by reference for all purposes.

TECHNICAL FIELD

The invention relates to oil well servicing, and more particularly to a mobile unit for performing well abandonment operations, including cement mixing and plug setting.

BACKGROUND

When an oil well is abandoned, it must be sealed and taken out of service. There are numerous steps involved in well abandonment which are guided by the legislation in the area the well is located. Generally, the inside of the wellbore is cleaned to remove any oil and gas that can cause corrosion in the wellbore and any identified issues in the wellbore are repaired. The different formations zones are isolated from one another in the wellbore, such as with bridge plugs covered with cement, and any groundwater zones are isolated from the wellbore to make sure that no oil, gas or water can travel up the wellbore and contaminate soil or groundwater. After these subsurface abandonment procedures are completed, the well is "cut-and-capped", which involves cutting the well casing to a certain distance below the surface and placing a vented cap on the well casing.

The well abandonment process can be expensive, time-consuming, and require various personnel, tool and vehicles at the wellsite to perform the different steps. For example, toolhands generally need to come to the wellsite with their tools and accompanying equipment to clean the well, set the plugs and test for leaks. Cementing the plugs requires a cement mixer and personnel come to the site to provide the cement. A separate water hauler vehicle is generally needed to bring water to the site for cement mixing and other purposes. All this equipment and personnel adds to the cost and time involved for well abandonment.

A review of the prior art shows various cement mixing systems such as in U.S. Pat. Nos. 6,488,088; 5,538,286; U.S. Patent Publication No. 2019/0048247; U.S. Pat. Nos. 5,571,281; 4,792,234; and 10,087,709, which are hereby incorporated by reference. General mobile equipment vehicles are taught in U.S. Pat. Nos. 10,184,300; 4,911,330; 8,276,658; and U.S. Patent Publication No. 2019/0203572, which are hereby incorporated by reference. U.S. Pat. Nos. 6,644,844; 5,895,116; CA 2,739,121; and U.S. Patent Publication No. 2018/0258736, incorporated herein by reference, teach mobile blender apparatuses.

SUMMARY

In accordance with the embodiments of the invention, there is provided a mobile wellsite service unit for providing equipment and services related to oil and gas well abandonment, the unit comprising a mobile transport containing at least one water storage tank; at least one cement mixing barrel having a first hydraulic motor connected to a movable paddle inside the barrel for mixing a cement slurry, the at least one cement mixing barrel having a drain for draining the cement slurry from the at least one mixing barrel; a trough for receiving the cement slurry from the drain of the at least one cement mixing barrel; a progressive cavity pump (PCP) having a drive system comprising a second hydraulic motor, the PCP connected to the trough for pumping the cement slurry from the trough for placement in the wellbore; and a hydraulic hose connected to the first hydraulic motor of the at least one cement mixing barrel and to the second hydraulic motor of the PCP for providing power to mix and pump the cement slurry, the hydraulic hose having a connector for connecting to a hydraulic power source.

The at least one cement mixing barrel may be an open-top, non-pressurized barrel. The at least one cement mixing barrel may further comprise jetting nozzles for spraying water into the mixing barrel to aid in mixing the cement slurry. In some embodiments, the movable paddle includes a rotatable vertical bar with arms extending away from the vertical bar.

In some embodiments, the PCP is capable of both positive and negative displacement of fluid through the PCP.

The mobile transport may further contain at least one downhole tool for use in well abandonment procedures. The at least one downhole tool may comprise any one of or a combination of the following tools: a cementing tool for placing cement in the wellbore; a well cleaning tool for cleaning the wellbore; a hydraulic setting tool for setting plugs in the wellbore; a casing collar locator; and a shear sub.

The hydraulic power source may be an auxiliary hydraulic system on a coiled tubing unit.

The mobile wellsite service unit may further comprise a hose connected to an end of the PCP for receiving the pumped cement slurry from the trough.

The at least one water storage tank may be connected via water lines to the at least one cement mixing barrel for providing water to the at least one cement mixing barrel.

The mobile transport may further contain any one of or a combination of the following: a tool storage unit; a tool cleaning bin; a workbench; a mechanical vice; and a pressure washer.

In other embodiments, there is provided a method for performing services at an oil and gas wellsite related to well abandonment using the mobile wellsite service unit, comprising the steps: a) connecting the hydraulic hose to the hydraulic power source; b) adding a predetermined amount of water and dry cement to the at least one cement mixing barrel; c) activating the movable paddle to mix the cement slurry in the at least one cement mixing barrel; d) draining the cement slurry from the at least one cement mixing barrel to the trough; and e) activating the PCP to pump the cement slurry from the trough for placement in a wellbore.

Prior to placing the cement slurry in the wellbore, a plug may be set in the wellbore using a hydraulic setting tool and pressure tested, after which the cement slurry is placed on top of the plug. Prior to setting the plug in the wellbore, the wellbore may be cleaned using a downhole cleaning tool.

In some embodiments, a cement spotting tool is used to place the cement slurry at a specific depth in the wellbore.

In some embodiment, the cement slurry is circulated into the wellbore using coil tubing.

BRIEF DESCRIPTION OF THE FIGURES

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION

Introduction and Rationale

Figure 1:
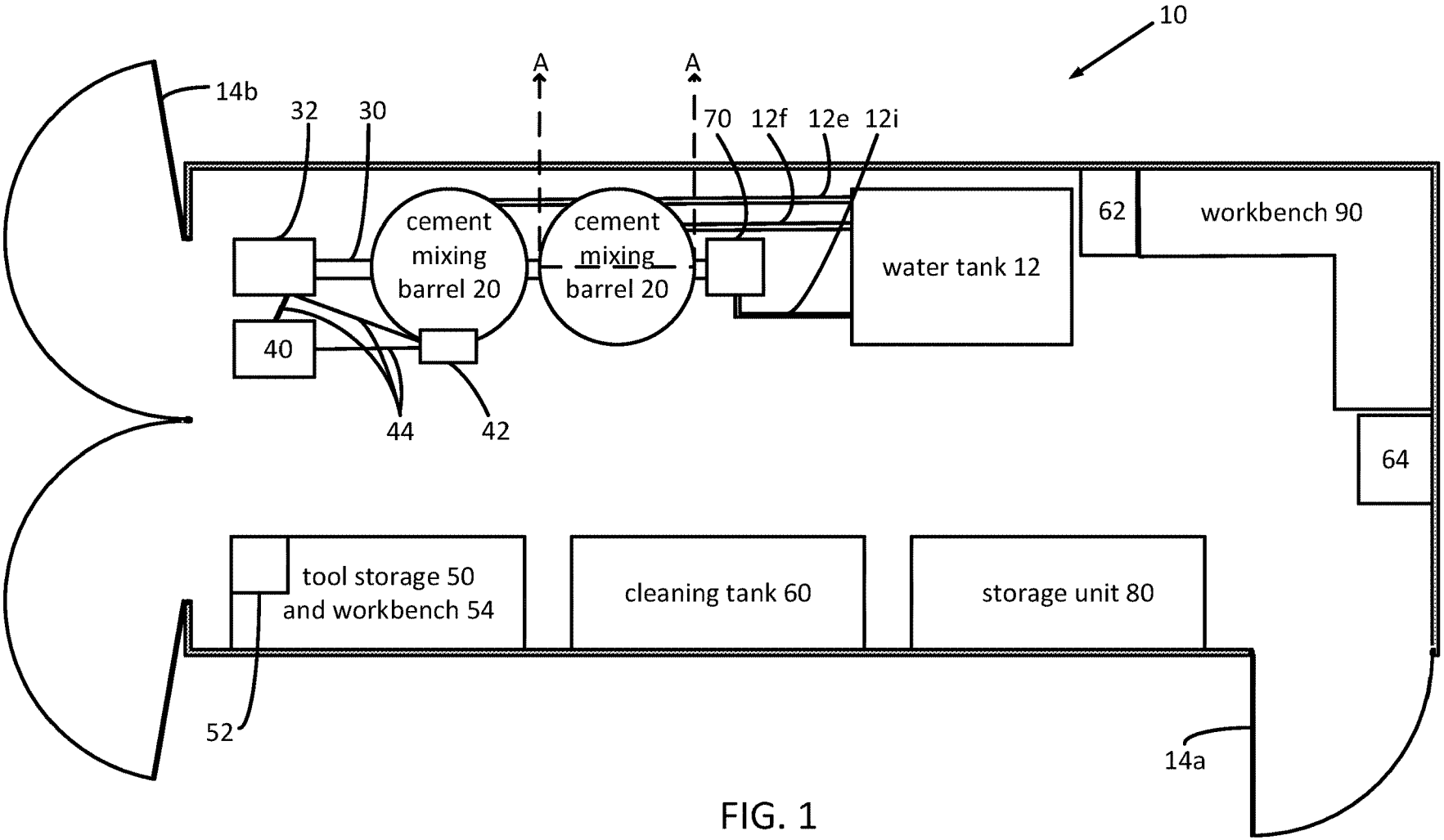
FIG. 1 is a plan view of a mobile unit in accordance with one embodiment of the invention, showing one embodiment of a lay out for components of the mobile unit inside a trailer.

The subject invention provides an all-in-one mobile unit that contains all the equipment and tools needed for well abandonment procedures, including cleaning the well, setting and testing plugs in the well to isolate the different zones, mixing cement, pumping the cement into the well, and cleaning and repairing the used tools. The mobile unit only requires one operator to transport the unit to and from the well and carry out the well abandonment procedures. The mobile unit is adaptable and can be operated in conjunction with equipment that is typically already at a well site, which may be a coiled tubing unit, service rig and/or wireline.

The subject invention was designed to reduce the costs and time involved in well abandonment. Well abandonments are costly and only provide a negative return on investment, therefore it is desirable to make well abandonment as efficient as possible. The subject invention does so by eliminating or reducing the need for additional personnel at a wellsite, like toolhands, cementers and fluid haulers. It also eliminates or reduces the need for additional vehicles to come to the wellsite with tools and equipment. By reducing the number of vehicles and operators brought to a wellsite for well abandonment procedures, greenhouse gas emissions are reduced as well as the equipment footprint at the wellsite which is particularly important in areas with sensitive ecosystems.

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

All-In-One Mobile Unit

There is provided a mobile unit 10 that contains various tools and equipment needed for well abandonment operations. As shown in the plan view of the mobile unit 10 in FIG. 1, the mobile unit generally includes one or more water tanks 12, one or more hydraulically powered cement mixing barrels 20, a progressive cavity pump 30, and a hydraulic hose 40. There may also be additional accessories, including a tool storage unit 50 and workbench 54, a cleaning tank 60, a storage unit 80, a workbench 90, a pressure washer 62 and a heater 64.

The mobile unit 10 is generally run in conjunction with a coil tubing unit that is already present at the wellsite. Alternatively, wells may have a wireline and/or a service rig present, in which case the mobile unit can be run in conjunction with the service rig and/or wireline.

Water Tank(s)

Figure 2:
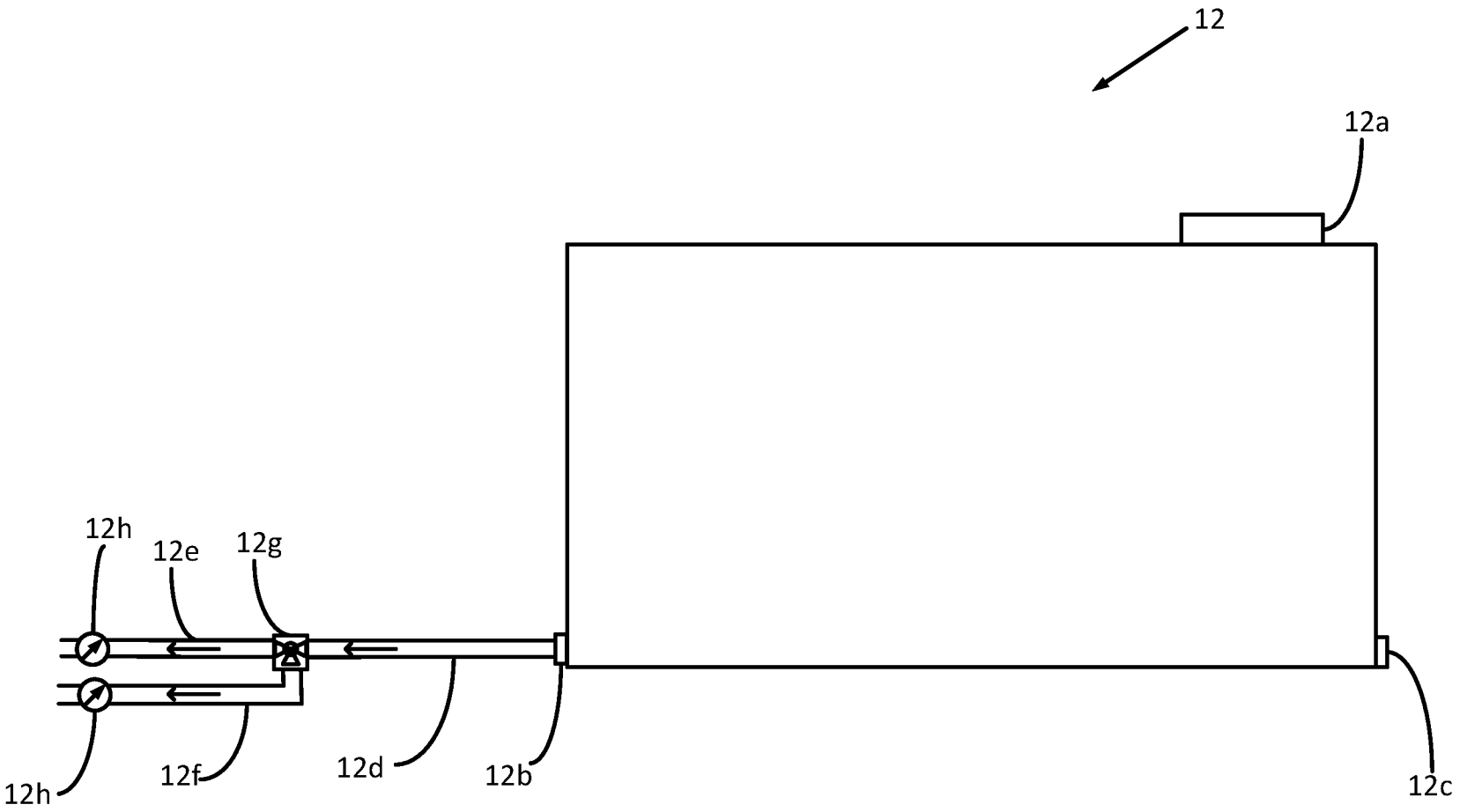
FIG. 2 is a side view of a water tank which is part of the mobile unit in accordance with one embodiment of the invention.

As shown in FIG. 1, the mobile unit 10 includes a water tank 12 that holds fresh water that can be used for making cement and other purposes as needed. FIG. 2 provides a side view of the water tank 12, which is preferably a closed top water tank with at least one inlet 12*a* for receiving water from an outside water source and one or more outlets 12*b*, 12*c* for removing water from the water tank. The one or more outlets 12*b*, 12*c* can be connected to one or more water lines for moving water to other areas and equipment inside or outside of the mobile unit 10.

At least one of the outlets 12*b* may be connected to the cement mixing barrel(s) 20 via at least one water line 12*d* to transfer water from the water tank to the cement mixing barrel(s) as needed. If there is more than one cement mixing barrel, there may be a water line to each cement mixing barrel from a separate outlet in the water tank, or the water line may split into more than one line 12*e*, 12*f* as shown in FIG. 2 to transport water separately to each cement mixing barrel. In this case, there would be a valve 12*g* to control the flow of water to each water line. The inlet(s) and outlet(s) also include valves (not shown) for controlling the flow of water. The water line(s) may include one or more inline gauges 12*h* for measuring the amount of water that is transferred from the water tank to the cement mixing barrel(s).

Another one of the outlets 12*c* may be used to remove water from the tank for other purposes, such as tool cleaning, or if a user wishes to move water manually from the water tank 12 to the cement mixing barrel(s) 20.

One or more of the outlets in the water tank may also be connected to a water line 12*i* that flows to a cement trough 70 for cleaning the cement trough, and/or to the pressure washer 62.

The size of the water tank(s) varies depending on the amount needed, but typically one or more tanks that can hold a volume of approximately 1 $m^3$ (1000 L) is sufficient for most well completion operations. If more water is needed, a larger tank and/or an additional tank can be provided, or water can be provided from an outside source.

Cement Mixing Barrel(s)

Figure 3:
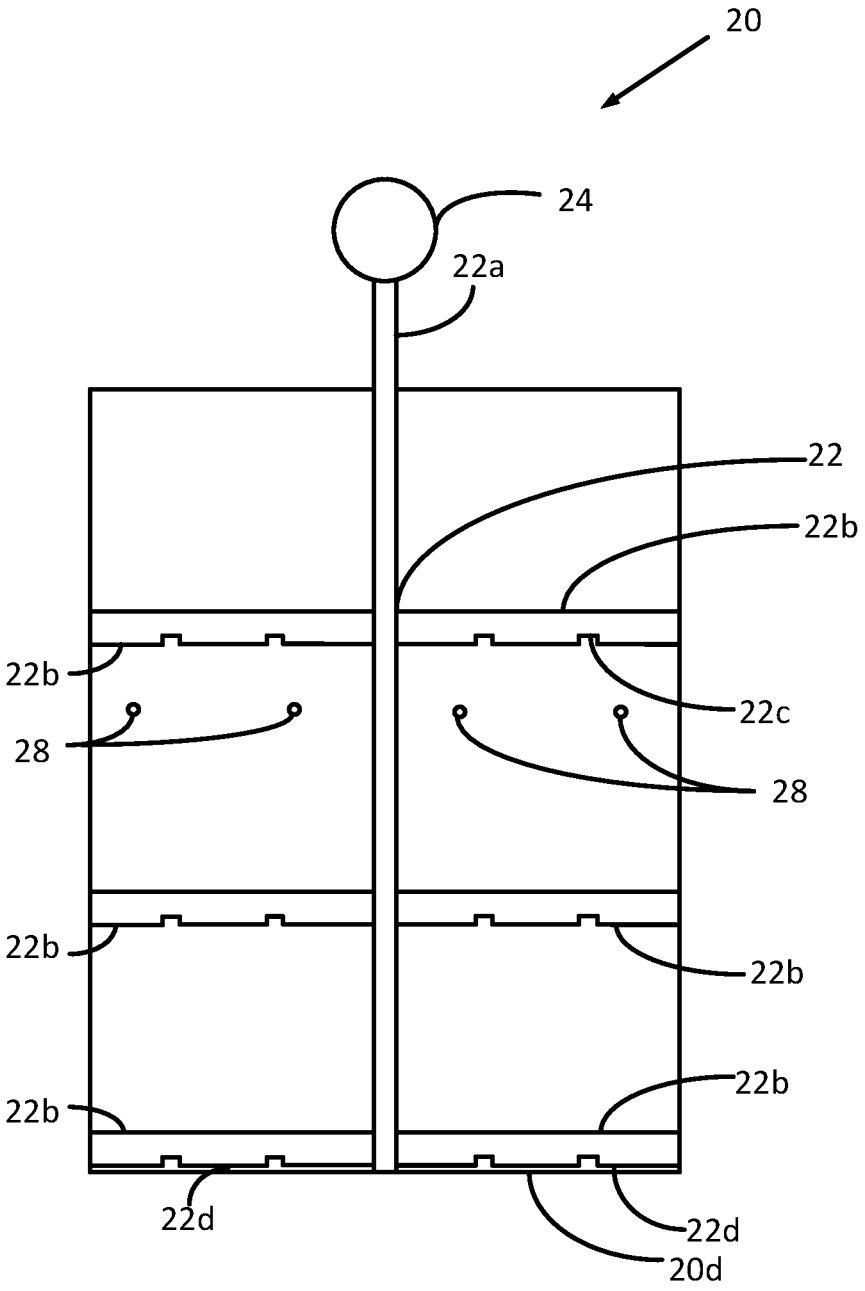
FIG. 3 is a cross-sectional side view of a cement mixing barrel taken along line A-A in FIG. 1 in accordance with one embodiment of the invention, showing a configuration for a mixing paddle in the cement mixing barrel.
Figure 4:
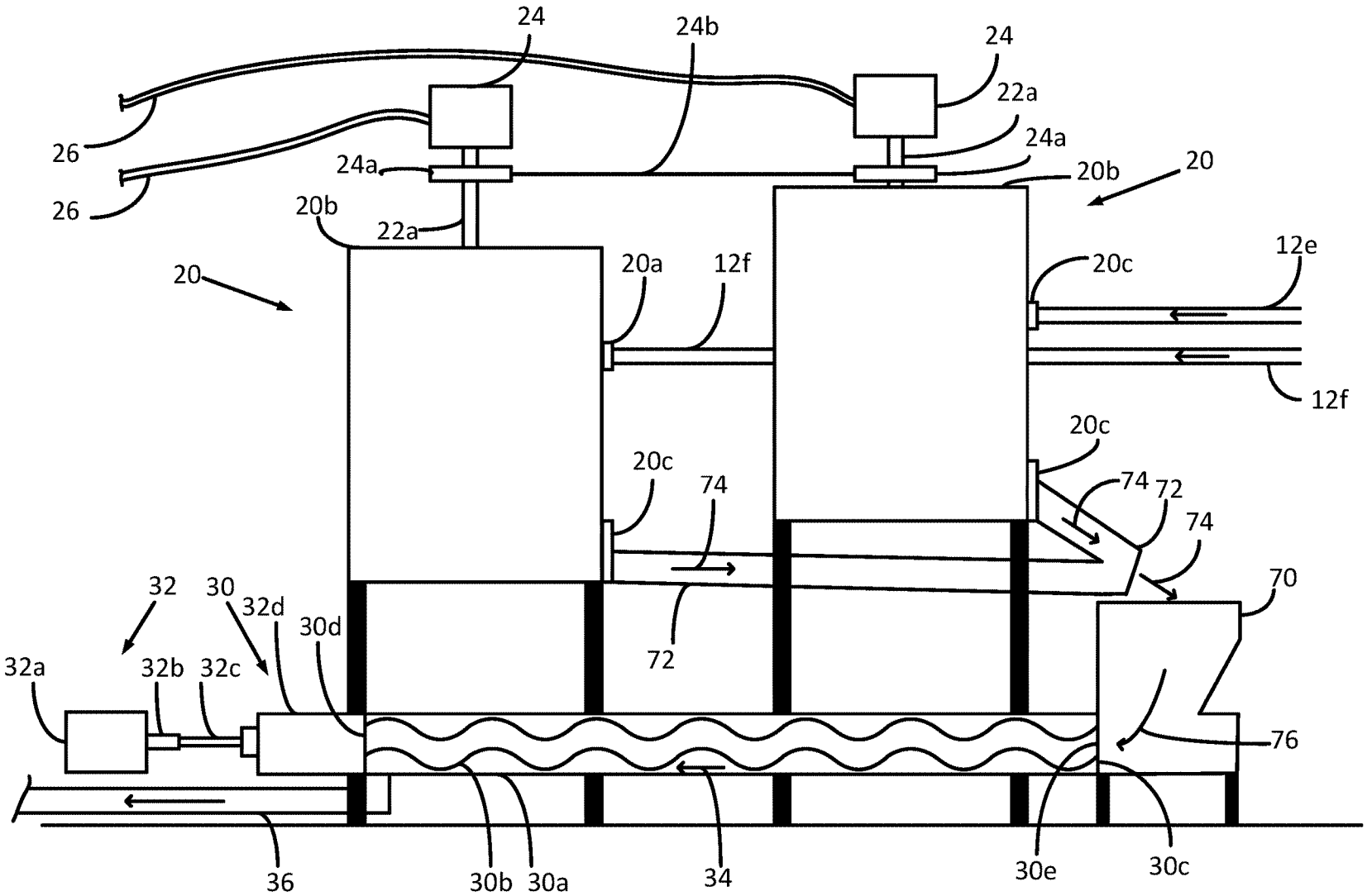
FIG. 4 is a side view of components of the mobile unit in accordance with one embodiment of the invention, showing two cement mixing barrels and a progressive cavity pump.

The mobile unit 10 includes one or more cement mixing barrels 20, as shown in the plan view of the mobile unit in FIG. 1. FIG. 3 illustrates a cross-sectional view of the cement mixing barrel 20, taken along line A-A in FIG. 1. FIG. 4 illustrates the connection of the cement mixing barrels 20 to other components of the mobile unit. The one or more cement mixing barrels 20 are preferably non-pressurized barrels, i.e. open top barrels, that have a mixing paddle 22 in the interior of the barrel that rotates to mix water and dry cement into a cement slurry. In some embodiments, the mixing paddle 22 comprises a vertical rod 22*a* with a plurality of paddles 22*b* that extend horizontally outward from the vertical rod 22*a*. The vertical rod 22*a* is attached to a hydraulic motor 24 connected to the hydraulic hose 40 via a hydraulic hose 26 (shown in FIG. 4) to provide power to the hydraulic motor 24. When the motor 24 is activated using controls 42, it rotates the rod 22*a* and the attached paddles 22*b* to mix the cement slurry in the mixing barrel 20. As shown in FIG. 4, when there is more than one cement mixing barrel 20, the mixing paddles 22 for each barrel may be connected via sprockets 24*a* and a chain driver 24*b* to transmit movement from one mixing barrel paddle to the other. This allows for only one hydraulic motor 24 to be used, eliminating the need for a hydraulic motor for each mixing barrel, or alternatively allowing each hydraulic motor 24 to be used with each mixing barrel to provide a backup in case a motor needs maintenance or is no longer working.

There can be various configurations for the mixing paddle 22. The embodiment illustrated in FIG. 3 shows several pairs of paddles 22*b* that are placed at various levels along the length of the vertical rod 22*a*. Alternatively, the paddles may be offset at various heights along the vertical rod, and there may any number of paddles. The paddles 22*b* may include voids 22*c* to increase the ease at which the paddles move through the cement slurry. The lowermost paddles may include rubber 22*d* on the bottom surface to scrape the bottom of the barrel 20*d* during mixing. The paddles are illustrated as extending perpendicularly from the vertical bar, however they may also extend at other angles.

The mixing barrel may include jetting nozzles 28 for agitating the cement to ensue better mixing. The jetting nozzles 28 are connected to the water tank 12 via a water line (not shown), which includes a pump and associated controls to pump water through the jets at high speed. The pump is connected to the hydraulic hose 40 to provide power to the pump.

Referring to FIG. 4, each mixing barrel 20 includes one or more inlets 20*a* for receiving water from the water tank via water lines 12*e*, 12*f* or from an outside water source. The barrel top 20*b* is open and dry cement can be added to the barrel through the top opening. Water can also be added to the barrel through the top opening via a bucket or hose instead of or in addition to using the water lines 12*e*, 12*f*.

Each mixing barrel includes a drain 20*c* at or near the bottom of the barrel that can be opened to drain cement slurry from the barrel into a trough 70 via drainpipes 72, shown by the arrows 74. The trough 72 feeds the cement slurry into the progressive cavity pump 30, shown by arrow 76.

The volume and number of cement mixing barrels can vary depending on several factors, including the quantity of cement needed. It is generally desirable to have more than one cement mixing barrel so that a batch of cement can be mixed in one barrel while mixed cement from another barrel is being used. Having more than one mixing barrel also provides a backup barrel in case one mixing barrel needs repairs. In general, a cement mixing barrel capacity of 500 L is sufficient for a typical well abandonment job. This may be divided into multiple mixing barrels that have a combined capacity of at least 500 L, for example two barrels having a 250 L to 300 L capacity, or by using one large mixing barrel with 500 L capacity.

Progressive Cavity Pump (PCP)

Referring to FIG. 4, the PCP 30 comprises a fixed stator 30*a* (a tubular housing) with a helical rotor 30*b* inside the stator. Spinning of the rotor allows for displacement of fluid in the PCP from a first end 30*c* of the stator to a second end 30*d*. The PCP comprises drive equipment 32 that preferably includes a hydraulic motor 32*a* that rotates a drive shaft 32*b* and polished rod 32*c* that is connected to the rotor 30*b*. A stuffing box 32*d* provides a pressure barrier between the drive equipment 32 and the stator 30*a* and rotor 30*b*. The rotor 30*b* can be spun in either direction so that the PCP can be used as a both a positive and a negative displacement pump. That is, the PCP can move fluid from the first end 30*c* to the second end 30*d* (positive displacement), or in the reverse from the second end 30*d* to the first end 30*c* (negative displacement).

The PCP 30 can be used for several purposes, including pumping cement into the well, pressure testing bridge plugs, and cleaning lines through reverse circulation.

Pumping Cement

When the PCP 30 is used for pumping cement, the stator 30*a* of the PCP includes an opening 30*e* at the first end 30*c* to feed cement from the trough 70 into the PCP. When the PCP is turned on and the rotor is rotating in the direction of positive displacement, cement is pumped from the cement trough 70 to the second end 30*d* of the PCP, shown by arrow 34 in FIG. 4. The second end 30*d* of the PCP is connected to a hose 36 through which the cement is pushed through into the coiled tubing and/or other tools as needed (e.g. cement spotting tool) for circulating cement into the wellbore. After cement is pumped into the coiled tubing, the PCP rotation can be reversed to remove leftover cement from the hose 36 and the PCP 30 by circulating it back through the PCP to the trough in the opposite direction that it was pumped out. The ability to reverse circulate is advantageous in that it eliminates the chance of cement or other fluids draining out of the hose and contaminating the soil at a wellsite when the hose is disconnected.

Preferably, the PCP can pump at a rate of 150 L/minute or more.

Tools

The mobile unit 10 includes several downhole tools that are used in well abandonment procedures. The tools may include a well cleaning tool (e.g. a casing scraper and/or a gauge ring), a casing collar locator, a shear sub and connector, a hydraulic setting tool, a packer (e.g. a J'latch packer), a cement spotting tool, a coil connector, and associated redress kits.

The well cleaning tool is used to clean the inside of the wellbore at the commencement of well abandonment procedures to remove any residual oil and gas that can cause corrosion in the wellbore or cause cement plugs to leak and to remove any obstructions so they won't be tagged when running other tools in hole. The well cleaning tool may be a casing scraper which has blades that are rotated to scrape the inside walls of the well casing clean. The well cleaning tool can also be a gauge ring that is sized just under the outer diameter of the casing inner diameter to push any residue and/or obstructions in its path through the casing. Any major obstructions that cannot be removed by the well cleaning tool can be tagged and dealt with in a different manner.

The casing collar locator is used to mechanically locate casing collars in the wellbore to accurately determine the depth of the tubing string (or drillpipe or wireline) by correlating the located casing collars (with known depth) with the logged depth of the tubing string. The casing collar locator is generally run in hole alongside other tools to accurately determine the depth of the tool.

The safety shear sub is a releasing assembly that allows an operator to disconnect from the tubing string (or drill pipe or wireline) when it is stuck downhole. It is generally used in conjunction with other tools to allow disconnection of the safety shear sub and tool located below it if problems are encountered.

The hydraulic setting tool is a pressure activated setting tool ran on coiled tubing or drill pipe to set plugs, such as bridge plugs, in the wellbore to seal the lower wellbore. It is usually used in conjunction with the casing collar locator and the safety shear sub and connector.

The packer is used to isolate and seal production zones from each other, which is used for pressure testing bridge plugs during well abandonment procedures. The packer may be a J'Latch packer that allows for reseattability without surfacing the tool, making it ideal for pressure testing multi-zone wells.

The cement spotting tool is run in hole to place cement at a specific location in the wellbore, such as on top of a bridge plug that has been set in the wellbore. Generally the cement spotting tool is filled with cement, then run in hole to the desired depth, after which the pressure is increased to shear the shear pins in the cement spotting tool, allowing the cement to be released downhole.

The coil connector is used to connect the various tools to coiled tubing string.

The redress kits are used to redress the tools after use, which may include replacing O-rings, seals and shear screws.

The tools are generally run in hole using a coiled tubing unit, but most tools can also be run in hole with drillpipe and/or a wireline. Alternate tools may be provided depending if a wireline or drillpipe is used. For example, the cement spotting tool may need to be a different tool (e.g. a dump bailer) if it is run in hole with a wireline instead of coiled tubing.

The tools are preferably stored in a tool storage rack in the mobile unit for easy access. The tool storage rack may be a combination tool storage rack with a repair area on top of the rack, as shown by tool storage 50 and workbench 54 in FIG. 1.

Hydraulic Hose

The mobile unit 10 includes a hydraulic hose 40, preferably on a reel, that connects to an auxiliary hydraulic power system at the wellsite, such as one that is part of a coiled tubing unit or a service rig which is generally driven by an electric motor or combustion engine. Alternatively, or in addition, a hydraulic pump may be an integral part of the mobile unit 10 to provide hydraulic power to the mobile unit 10 instead of or in addition to auxiliary hydraulics at the wellsite.

The hydraulic hose 40 is connected via hydraulic lines 44 to the components of the mobile unit 10 that require hydraulic power, which includes the hydraulic motor 32*a* of the PCP pump 30 and the hydraulic motor 24 of the cement mixing barrels 20. Various hydraulic controls 42 and gauges are included as needed to run the hydraulic power system.

Mobile Unit

Figure 5:
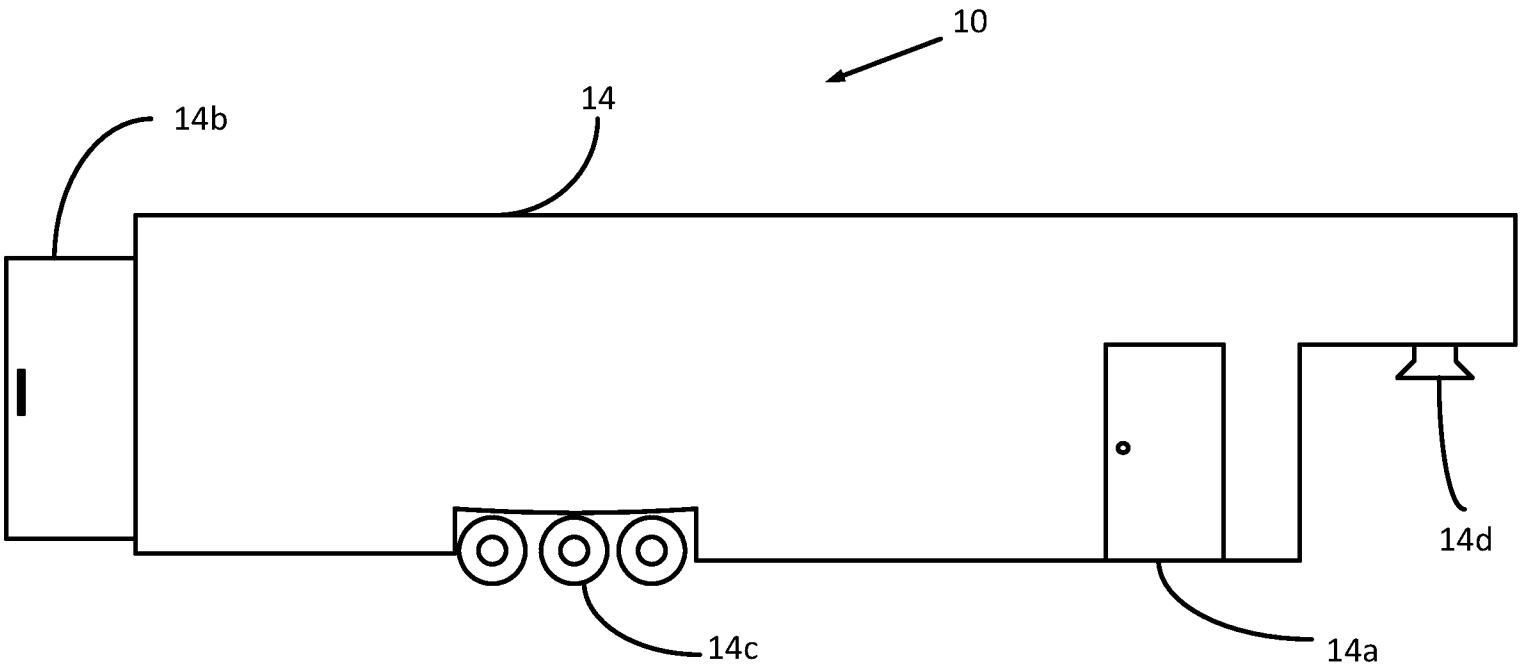
FIG. 5 is a side view of a trailer as part of the mobile unit in accordance with one embodiment of the invention.

The mobile unit 10 can be in various forms. In some embodiments, the mobile unit is a closed trailer 14, such as the one shown in FIG. 5, which houses the components of the mobile unit. The components are preferably mounted to the floor and/or walls of the trailer, such as by legs 82 shown in FIG. 4. The trailer 14 includes one or more doors, such as a side door 14*a* and a rear door 14*b*, which can be opened to access the components inside the trailer and through which components inside the trailer can be connected to components outside of the trailer, for example the hydraulic hose 40 connecting to auxiliary hydraulics and the PCP 30 and hose 36 connecting to a coiled tubing unit.

The mobile unit 10 includes wheels 14*c* to allow mobility of the unit, and a hitch mechanism 14*d* for attaching to a vehicle to move the mobile unit. Alternatively, the mobile unit may be an integrated part of a vehicle that does not need to be moved by another vehicle. The mobile unit may also be mounted on an open trailer or open truck bed.

Storage, Cleaning and Repair Units and Other Accessories

The mobile unit can include a tool cleaning and repair area for cleaning and repairing downhole tools. After using a tool, it is generally recommended to disassemble, inspect, and clean all parts and replace all seals, o-rings, and shear screws. The tool cleaning and repair area includes various components to make this easy, such as a cleaning tank 60 containing varsol into which tools or tool components can be placed for cleaning and degreasing. The cleaning tank may have the varsol contained in a manner such that it is only accessed when tools are being cleaned, and then is contained when being transported. There may also be one or more work benches 54, 90 with one or more vises 52 for clamping tools during assembly, disassembly, cleaning and repair. The vise 52 may be a mechanical chain vise for gripping tools.

The mobile unit 10 also provides one or more storage areas for everything that is needed for the well abandonment procedures, including cement, bridge plugs, other required reagents, and tools. This may include a storage unit 80, as shown in FIG. 1, along with a tool storage unit 50 underneath a work bench/tool repair area 54.

A pressure washer 62 may also be present in the mobile unit to aid in cleaning the various components after use, such as the cement mixing barrels, progressive cavity pump and associated parts. The pressure washer can be connected to the water tank for fluid and include a pump to pressurize the fluid going through the washer, the pump being connected to the hydraulic hose for power.

The mobile unit can also include a heater 64 for heating the trailer and components within the trailer when it is in a cold environment.

Procedure

When a well is to be abandoned, the mobile unit 10 is transported to the wellsite to perform the well abandonment operations. These procedures generally include:

a. Connecting the hydraulic hose 40 to a hydraulic power system, which may be part of the mobile unit or an auxiliary hydraulic power system that is at the wellsite as part of the coil tubing unit or service rig.

b. Running the well cleaning tool, preferably a casing scraper and/or a gauge ring, downhole to clean the wellbore and ensure no obstructions will be tagged when running in hole with the hydraulic setting tool.

c. Setting a bridge plug in the wellbore above the lowermost formation in the reservoir with the hydraulic setting tool, preferably in conjunction with the casing collar locator to accurately determine the depth the bridge plug is being set at, and the safety shear sub and connector.

d. Pressure testing the bridge plug to ensure it is set properly and meets the requirements, which may vary by jurisdiction. In the province of Alberta in Canada, the bridge plug must withstand a stabilized pressure of 7000 kPa for 10 minutes. One way to pressure test is to run the packer tool (e.g. J'latch packer) downhole and set it above the bridge plug to isolate the lower and upper wellbore sections from each other, then increase the pressure below the packer to conduct the pressure test. The pressure can be increased by pumping fluid downhole using the PCP or other means such as a fluid truck if it is available at the wellsite. Compressed air or nitrogen can also be used for pressure testing in certain circumstances.

e. Calculating the cement volume needed to put on top of the bridge plug, and calculating the water volume and dry cement volume based on the total cement volume needed. It is often required to place 8 linear meters of cement in the wellbore above a bridge plug for well abandonments. The cement volume can be calculated based on the well casing size, the amount of cement required on top of the plug, and any horizontal deviation in the wellbore.

f. Preparing the cement slurry by adding the calculated water and dry cement to the mixing barrel 20, then turning on the hydraulic mixing paddle 22 and optionally the jetting nozzles 28 to mix the cement slurry. The cement slurry can be tested with a densometer to ensure it is of the proper consistency.

g. Feeding the cement slurry into the trough 70 through the drainpipes 72 and the drain 20*c* in the mixing barrel 20.

h. Placing cement on top of the bridge plug downhole. There are several options for cementing, which include:

i. Using the cement spotting tool with coiled tubing. In this case the PCP 30 is connected to the coiled tubing with hose 36, and when the PCP is turned on to forward circulate, it moves the cement slurry from the trough 70, through the PCP 30, through the hose 36, and through the coiled tubing to the cement spotting tool at the end of the tubing. Once the tubing has been filled with the predetermined cement volume, it is run in hole to above the bridge plug and pressured up until the shear pins shear to release the cement on top of the bridge plug. The PCP is then reverse circulated to move any residual cement slurry in the hose back through the PCP and into the trough.

ii. Instead of using the cement spotting tool, the cement slurry can be forward circulated through the coil tubing that is run in hole, causing the cement to exit the end of the tubing on top of the bridge plug. This can be done if a larger volume of cement is needed up to 1 $m^3$.

iii. Alternatively, in the case where a wireline is being used instead of coil tubing, the cementing tool may be a dump bailer instead of a cement spotting tool which is used to dump cement on top of the bridge plug.

i. If it is a multi-zone well, steps c to h are repeated for each zone, i.e. at each zone a plug is set, pressure tested, and then cement is placed on top of the plug.

j. After each zone has been plugged and cemented, the tools can be disassembled, cleaned up, replacement parts added, and reassembled as needed using the tool cleaning/repair area in the mobile unit.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A mobile wellsite service unit for providing equipment and services related to oil and gas well abandonment, the unit comprising:

a mobile transport containing:

at least one water storage tank;

at least one cement mixing barrel having a first hydraulic motor connected to a movable paddle inside the barrel for mixing a cement slurry, the at least one cement mixing barrel having a drain for draining the cement slurry from the at least one mixing barrel;

a trough for receiving the cement slurry from the drain of the at least one cement mixing barrel;

a progressive cavity pump (PCP) having a drive system comprising a second hydraulic motor, the PCP connected to the trough for pumping the cement slurry from the trough for placement in the wellbore; and hydraulic lines connected to the first hydraulic motor of the at least one cement mixing barrel and to the second hydraulic motor of the PCP for providing power to mix and pump the cement slurry, the hydraulic lines having a connector for connecting to a hydraulic power source, wherein the mobile transport further contains at least one down hole tool for use in well abandonment procedures, wherein the at least one downhole tool comprises any one of or a combination of the following tools: a well cleaning tool for cleaning the wellbore; a hydraulic setting tool for setting plugs in the wellbore; a casing collar locator; and a shear sub.

2. The mobile wellsite service unit according to claim 1, wherein the at least one cement mixing barrel is an open-top, non-pressurized barrel.

3. The mobile wellsite service unit according to claim 1, wherein the PCP is capable of both positive and negative displacement of fluid through the PCP.

4. The mobile wellsite service unit according to claim 1, wherein the hydraulic power source is an auxiliary hydraulic system on a coiled tubing unit.

5. The mobile wellsite service unit according to claim 1, further comprising a hose connected to an end of the PCP for receiving the pumped cement slurry from the trough.

6. The mobile wellsite service unit according to claim 1, wherein the movable paddle includes a rotatable vertical bar with arms extending away from the vertical bar.

7. The mobile wellsite service unit according to claim 1, wherein the at least one cement mixing barrel further comprises jetting nozzles for spraying water into the mixing barrel to aid in mixing the cement slurry.

8. The mobile wellsite service unit according to claim 1, wherein the at least one water storage tank is connected via water lines to the at least one cement mixing barrel for providing water to the at least one cement mixing barrel.

9. The mobile wellsite service unit according to claim 1, wherein the mobile transport further contains any one of or a combination of the following: a tool storage unit; a tool cleaning bin; a workbench; a mechanical vice; and a pressure washer.

10. A method for performing services at an oil and gas wellsite related to well abandonment using the mobile wellsite service unit according to claim 1, comprising the steps:

a) connecting the hydraulic lines to the hydraulic power source;

b) adding a predetermined amount of water and dry cement to the at least one cement mixing barrel;

c) activating the movable paddle to mix the cement slurry in the at least one cement mixing barrel;

d) draining the cement slurry from the at least one cement mixing barrel to the trough; and e) activating the PCP to pump the cement slurry from the trough for placement in a wellbore.

11. The method according to claim 10, wherein prior to placing the cement slurry in the wellbore, a plug is set in the wellbore using a hydraulic setting tool and pressure tested, after which the cement slurry is placed on top of the plug.

12. The method according to claim 11, wherein prior to setting the plug in the wellbore, the wellbore is cleaned using a downhole cleaning tool.

13. The method according to claim 10, wherein a cement spotting tool is used to place the cement slurry at a specific depth in the wellbore.

14. The method according to claim 10, wherein the cement slurry is circulated into the wellbore using coil tubing.

15. A mobile wellsite service unit for providing equipment and services related to oil and gas well abandonment, the unit comprising:

a mobile transport containing:

at least one water storage tank;

at least one open-top, non-pressurized cement mixing barrel having a first hydraulic motor connected to a movable paddle inside the barrel for mixing a cement slurry, the at least one cement mixing barrel having a drain for draining the cement slurry from the at least one mixing barrel;

a trough for receiving the cement slurry from the drain of the at least one cement mixing barrel;

a progressive cavity pump (PCP) capable of positive and negative displacement and having a drive system comprising a second hydraulic motor, the PCP connected to the trough for pumping the cement slurry from the trough for placement in the wellbore;

hydraulic lines connected to the first hydraulic motor of the at least one cement mixing barrel and to the second hydraulic motor of the PCP for providing power to mix and pump the cement slurry, the hydraulic lines having a connector for connecting to an auxiliary hydraulic power source; and at least one downhole tool for use in well abandonment procedures, wherein the at least one down hole tool comprises anyone of or a combination of the following tools: a well cleaning tool for cleaning the wellbore; a hydraulic setting tool for setting plugs in the wellbore; a casing collar locator; and a shear sub.

* * * * *